US005235123A

United States Patent [19]

Chiang

[11] Patent Number: 5,235,123

[45] Date of Patent: Aug. 10, 1993

[54] MUSIC BOX

[76] Inventor: Chieh-Tseng Chiang, 4-1F., No. 91, Sec. 2, Roosevelt Rd., Taipei, Taiwan

[21] Appl. No.: 860,752

[22] Filed: Mar. 25, 1992

[51] Int. Cl.[5] ..... G10F 1/06

[52] U.S. Cl. ..... 84/95.1

[58] Field of Search ..... 84/94.1, 94.2, 95.1, 84/96, 95.2

[56] References Cited

U.S. PATENT DOCUMENTS

| | | | |
|---|---|---|---|
| 2,879,684 | 3/1959 | Ganine | 84/94.1 |
| 2,880,639 | 4/1959 | Gorr | 84/94.1 |
| 3,724,316 | 4/1973 | Kinberg et al. | 84/95.1 |
| 4,616,549 | 10/1986 | Lan | 84/94.1 |

*Primary Examiner*—Michael L. Gellner
*Assistant Examiner*—Patrick Stanzione

[57] ABSTRACT

A music box comprising two opposed metal combs with tuned steel teeth respectively disposed at two opposite sides relative to a pinned barrel, a driving mechanism to rotate said pinned barrel, and an adjusting device controlled to move either metal comb into the operative position, wherein rotating said adjusting device in one direction causes the tuned steel teeth of one metal comb to be struck by the pins on the outer wall of said pinned barrel in producing a certain tune or tunes; rotating said adjusting device in an opposite direction causes the tuned steel teeth of the other metal comb to be struck by the pins on the inner wall of said pinned barrel in producing a different tune or tunes.

3 Claims, 2 Drawing Sheets

MUSIC BOX

BACKGROUND AND SUMMARY OF THE INVENTION

The present invention relates to music boxes, and more particularly, the present invention relates to a music box that can be adjusted to produce different tunes.

FIG. 1 illustrates the internal structure of a music box according to the prior art, which is generally comprised of a metal comb with tuned steel teeth that are struck by pins so arranged on a revolving barrel as to produce a certain tune or tunes. Because the pins are arranged on the revolving barrel at the outside, only one metal comb with tuned steel teeth can be struck to produce a certain tune or tunes. If different tune or tunes are to be produced, a different revolving barrel shall be used. However, replacing the revolving barrel of a music box is not so easy.

The present invention has been acomplished under the aforesaid circumstances. It is therefore an object of the present invention to provide a music box which can be conveniently adjusted to produce different tune or tunes. This object is achieved by arranging pins on the outer wall as well as the inner wall of a revolving barrel according to the desired tunes, and setting one metal comb with tuned steel teeth at the inside of the revolving barrel and another metal comb with tuned steel teeth at the outside of the revolving barrel. An adjusting screw is fastened in a hole of the housing of the music box to adjust the position of the metal combs. Rotating the adjusting screw in one direction causes one metal comb to be struck by the pins on the outer wall of the revolving barrel for producing a certain tune or tunes; rotating the adjusting screw in an opposite direction causes the other metal comb to be struck by the pins on the inner wall of the revolving barrel for producing different tune or tunes.

DETAILED DESCRIPTION OF THE PREFERRED EMBODIMENT

Figure 2:
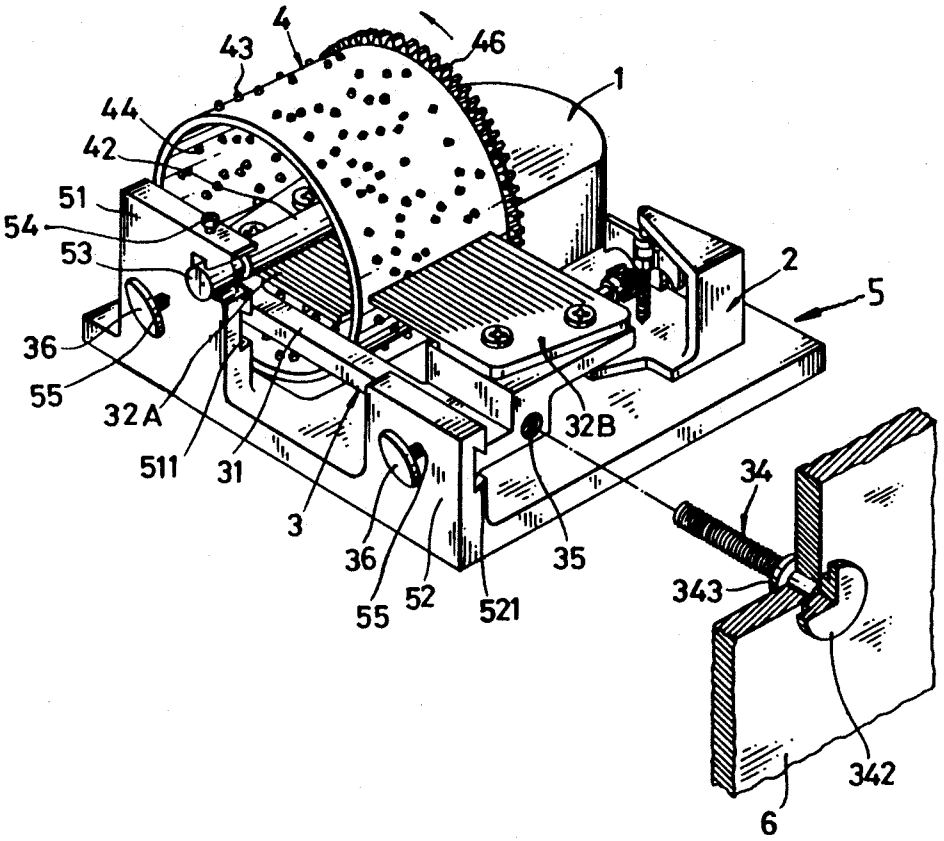
FIG. 2 is an elevational and partly exploded view of the internal mechanical structure of the preferred embodiment of the music box of the present invention.
Figure 1:
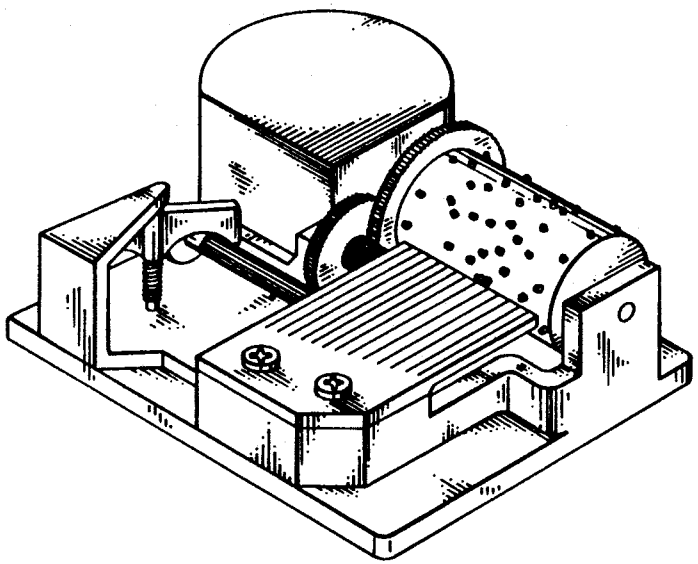
Fig. 1 PRIOR ART
FIG. 1 is an elevational view of the internal mechanical structure of a prior art music box.
Figure 4:
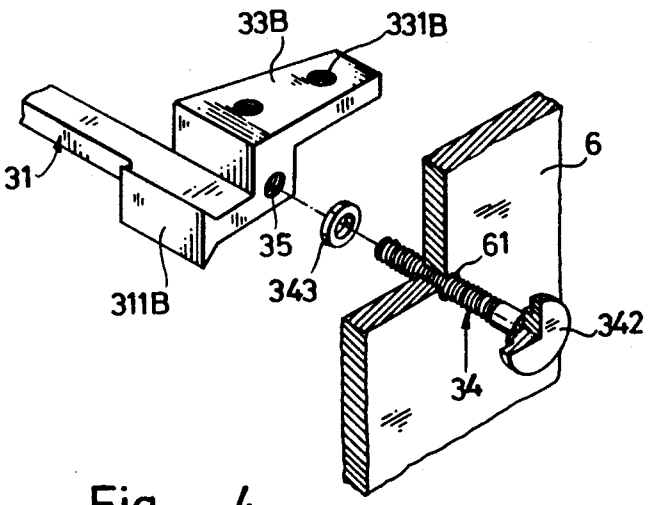
FIG. 4 illustrates the positioning of the adjusting screw in a hole on the housing for controlling the position of the metal comb assembly.
Figure 3:
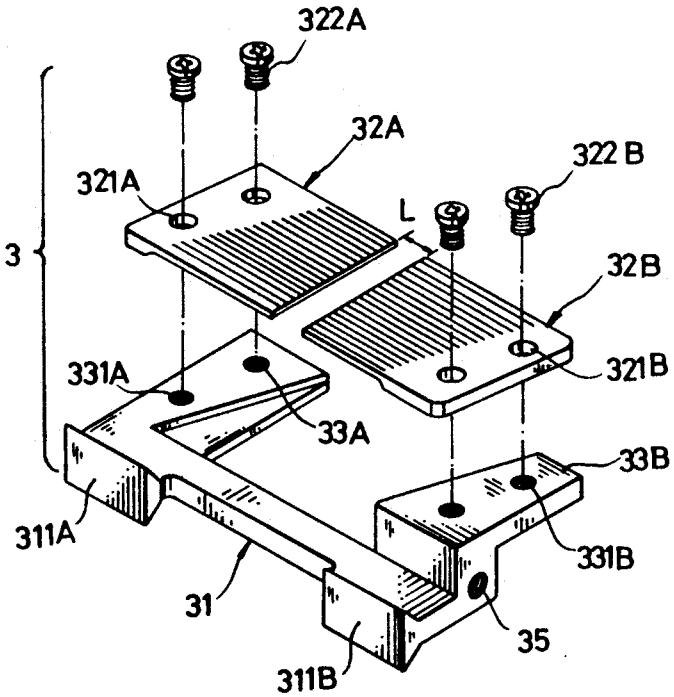
FIG. 3 is an exploded view of the metal comb assembly.

Referring to FIGS. 2, 3 and 4, a music box as constructed in accordance with the present invention is generally comprised of a base 5 having a driving mechanism 1, a speed adjusting device 2, a metal comb assembly 3 and a pinned barrel 4 respectively mounted thereon. The driving mechanism 1 and the speed adjusting device 2 are of the known art and not within the scope of the present invention, and therefore, they are not described in detail. The pinned barrel 4 is driven to rotate by the driving mechanism 1 through a center shaft 42, having a gear wheel 46 in mesh with a gear (not shown)of the speed adjusting device 2. By means of adjusting the speed adjusting device 2, the revolving speed of the pinned barrel 4 is controlled. The pinned barrel 4 further comprises pins 43 and 44 arranged on the outer wall as well as the inner wall thereof. The base 5 comprises two vertical side walls 51 and 52 at one side with two dovetail grooves 511 and 521 transversely respectively formed thereon at an inner side for fastening the metal comb assembly 3. Bolt holes 55 are respectively made on the vertical side walls 51 and 52 for fastening tightening up screws 36 in securing the metal comb assembly 3 to the base 5. A shaft holder 53 is secured in a hole (not shown) on the vertical wall 51 of the base 5 by a tightening up screw 54 to hold the center shaft 42 permitting it to be rotated thereon in turning the pinned barrel 4. The metal comb assembly 3 is comprised of a mounting plate 31 secured to the vertical side walls 51 and 52 of the base 5 to hold two metal combs 32A and 32B. The mounting plate 31 comprises two dovetail blocks 311A and 311B respectively inserted in the dovetail grooves 511 and 521, two platforms 33A and 33B transversely disposed at two opposite ends with bolt holes 331A and 331B respectively made thereon for securing the two metal combs 32A and 32B. The metal combs 32A and 32B have through holes 321A and 321B at locations corresponding to the bolt holes 331A and 331B on the platforms 33A and 33B. By inserting screws 322A and 322B through the through holes 321A and 321B into the bolt holes 331A and 331B, the metal combs 32A and 32B are secured to the platforms 33A and 33B of the mounting plate 31. When the metal comb assembly 3 has been secured to the vertical side walls 51 and 52, the metal comb 32A is disposed inside the pinned barrel 4 while the metal comb 32B is disposed outside the pinned barrel 4. Further, a bolt hole 35 is made on the platform 33B at right angle corresponding to the bolt holes 331B for inserting an adjusting screw 34. The adjusting screw 34 is inserted through a hole 61 on the housing 6 of the music box, a hole (not indicated) on a locating nut 343 into the bolt hole 35. The locating nut 343 is fixedly secured to the inner wall surface (not shown) of the housing 6, and therefore, the adjusting screw 34 can be rotated on the locating nut 343 and is prohibited from axial displacement. By rotating the head 342 of the adjusting screw 34 in one direction causes the mounting plate 31 to be moved forward (when the tightening up screws 36 are loosened) permitting the tuned steel teeth of the metal comb 32B to be struck by the pins 43 on the outer wall of the pinned barrel 4 in producing tune or tunes; rotating the head 342 of the adjusting screw 34 in an opposite direction causes the mounting plate 31 to be moved backward permitting the tuned steel teeth of the metal comb 32A to be struck by the pins 44 on the inner wall of the pinned barrel 4 in producing different tune or tunes.

I claim:

1. A music box comprising a pinned barrel driven by a driving mechanism to rotate above a base, said pinned barrel having pins arranged on an outer wall surface thereof and pins arranged on an inner wall surface thereof, a metal comb assembly to hold two opposed metal combs with tuned steel teeth, and an adjusting device to control the positioning of said metal comb assembly on said base, wherein rotating said adjusting device in one direction causes said metal comb assembly to be moved into a first operative position permitting the tuned steel teeth of one metal comb to be struck by the pins on the outer wall surface of said pinned barrel in producing a tune or tunes; rotating said adjusting device in an opposite direction causes said metal comb assembly to be moved into a second operative position permitting the tuned steel teeth of the other metal comb to be struck by the pins on the inner wall surface of said pinned barrel in producing different tune or tunes.

2. The music box of claim 1, wherein said metal comb assembly comprises two spaced dovetail blocks longitudinally aligned at one side and respectively inserted into two dovetail grooves on a vertical side wall of the said base and alternatively secured at said first or second operative position by tightening up screws.

3. The music box of claim 1, wherein said adjusting device comprises an adjusting screw revolvably secured in a hole on the outer shell of the music box by a locating nut and screwed into a bolt hole on said metal comb assembly, permitting said dovetail blocks to be moved forward or backward into said first or second operative position by turning said adjusting screw clockwise or counter-clockwise.

* * * * *